US008413296B1

(12) United States Patent
McGrew et al.

(10) Patent No.: US 8,413,296 B1
(45) Date of Patent: Apr. 9, 2013

(54) COASTER FOR COMMERCIAL KITCHEN EQUIPMENT

(75) Inventors: Pamela Raye McGrew, Cedar Rapids, IA (US); Merle Allen McGrew, Cedar Rapids, IA (US); Daniel R. Bentley, Hiawatha, IA (US)

(73) Assignee: Stoveshoes, LLC, Cedar Rapids, IA (US)

( * ) Notice: Subject to any disclaimer, the term of this patent is extended or adjusted under 35 U.S.C. 154(b) by 281 days.

(21) Appl. No.: 13/028,537

(22) Filed: Feb. 16, 2011

Related U.S. Application Data

(60) Provisional application No. 61/338,401, filed on Feb. 18, 2010.

(51) Int. Cl.
*A47B 91/04* (2006.01)

(52) U.S. Cl.
USPC ..... 16/42 R; 248/346.11

(58) Field of Classification Search ..... 16/42 R, 16/42 T, 18 R, 18 CG; 248/346.11, 188.9; 135/77, 82, 86
See application file for complete search history.

(56) References Cited

U.S. PATENT DOCUMENTS

| | | | | |
|---|---|---|---|---|
| 1,480,758 | A * | 1/1924 | Hight | 248/346.11 |
| 1,827,972 | A * | 10/1931 | Darnell | 16/42 R |
| 2,915,850 | A * | 12/1959 | Goodfellow | 248/346.11 |
| 3,524,614 | A * | 8/1970 | Sorth | 248/346.11 |
| 4,124,917 | A * | 11/1978 | Gilliland | 16/42 R |
| 5,295,598 | A * | 3/1994 | Gerlach et al. | 248/346.11 |
| 6,761,340 | B2 * | 7/2004 | Shaw | 248/346.11 |
| 7,610,655 | B2 * | 11/2009 | Thaw et al. | 16/42 R |
| 2008/0191106 | A1 * | 8/2008 | Shiffler et al. | 248/188.9 |

FOREIGN PATENT DOCUMENTS

JP 06092102 A * 4/1994

OTHER PUBLICATIONS

All Glides website: http://www.allglides.com/nylonglidecaps1.html.

* cited by examiner

*Primary Examiner* — Jeffrey O Brien
(74) *Attorney, Agent, or Firm* — Allan L. Harms; Shuttleworth & Ingersoll, PLC

(57) ABSTRACT

A coaster for heavy equipment in a commercial kitchen permits easier movement of the equipment for cleaning purposes. The coaster has a rigid, high strength body which includes a recess in the top surface which receives a leg of the heavy equipment, such as a commercial range. The coaster is cylindrical with a rounded lower edge and includes a drain passage between the floor of the recess and the outside of the sidewall. The coaster is made of a low friction polymer which is rugged and chemically resistant, such as polyoxymethylene.

16 Claims, 2 Drawing Sheets

COASTER FOR COMMERCIAL KITCHEN EQUIPMENT

CROSS REFERENCE TO RELATED APPLICATIONS

The present application claims priority under 35 USC §119 to provisional application 61/338,401 filed Feb. 18, 2010, which is incorporated herein by reference.

BACKGROUND

This invention pertains to restaurant kitchens and particularly to movement of kitchen equipment in a commercial kitchen environment.

Commercial ranges, deep fryers, refrigerators and other industrial kitchen equipment used in restaurants and other commercial kitchens are very heavy and difficult to move, even if equipped with casters as some equipment items are. However, in order to maintain a sanitary kitchen environment, it is necessary to clean the floor under the equipment and to do that adequately requires that the pieces of kitchen equipment be regularly moved.

Efforts to facilitate movement of kitchen equipment have included providing casters on the equipment. However, commercial kitchen equipment equipped with casters also present the problem of mop fibers becoming snagged under the caster wheels when floor mopping is carried out. Furthermore, caster wheels wear and require replacement over time. In addition, casters may not move smoothly over tiled floors or uneven floors while ordinary legs on commercial ranges and deep fryers without casters are especially hard to slide over tiled and uneven floors.

The difficulties of moving heavy restaurant kitchen equipment can lead to neglect of adequate cleaning procedures and to strain injuries suffered by those required to move the heavy equipment. This problem has existed for as long as there has been bulky commercial cooking equipment.

An improvement which permits easy moving of heavy commercial kitchen equipment is needed to facilitate proper cleaning of commercial kitchen areas.

SUMMARY OF THE INVENTION

The invention is a coaster for heavy equipment used in a commercial kitchen which permits easy sliding movement of the equipment for cleaning purposes. Each leg of a commercial range, a deep fryer, or other commercial kitchen equipment is supported by one coaster. The coaster has a rigid, high strength body which includes a cylindrical recess in the top surface which receives the leg or caster of the heavy equipment. The body of the coaster is cylindrical and rounded at the bottom edges and includes a drain passage extending between the recess and the outside of the coaster. The coaster is made of a low friction thermoplastic which is rugged and chemically resistant. Polyoxymethylene (polyacetal) is a satisfactory thermoplastic for construction of the coaster. In a preferred embodiment, the body of the coaster has a height of from one and one-half to two inches, a diameter of two and one-half to three and one-half inches and the recess in the top surface has a depth of from one-quarter to one inch and a diameter of one to one and one-half inches. The preferred embodiment includes a rounded edge between the sidewall of the cylindrical body and the bottom surface of the body. Beveled or rounded edges are provided at the upper edges of the recess in the top surface as well as at the intersection of the top surface with the cylindrical sidewall.

It is a primary object of the invention to provide a support for a heavy piece of commercial kitchen equipment which allows the commercial equipment to be moved across the kitchen floor with little effort so that cleaning below the equipment may be carried out. It is also an object of the invention to provide a coaster which will not tip or tilt when lateral forces are applied to the equipment supported by the coaster. It is a further object of the invention to provide a coaster which will not retain liquids in its recess.

These and other objects will become apparent from examination of the detailed description which follows.

DETAILED DESCRIPTION

The present invention provides a robust sliding element to support each leg of a commercial range or other heavy kitchen equipment or appliance found in a commercial kitchen or restaurant kitchen.

Figure 1:
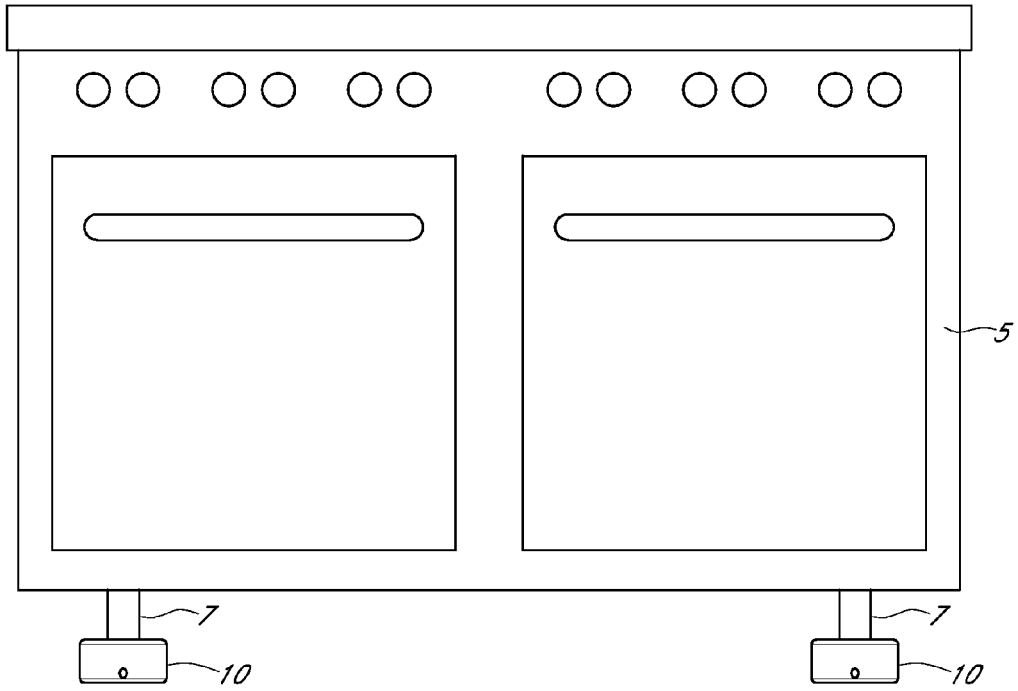
FIG. 1 illustrates a commercial kitchen appliance such as a commercial range supported by units of the invention.

Referring first to FIG. 1, a commercial range 5 is shown with each leg 7 thereof supported by a unit of the invention 10. Typically, commercial range 5 may weigh in excess of 500 pounds.

Figure 2:
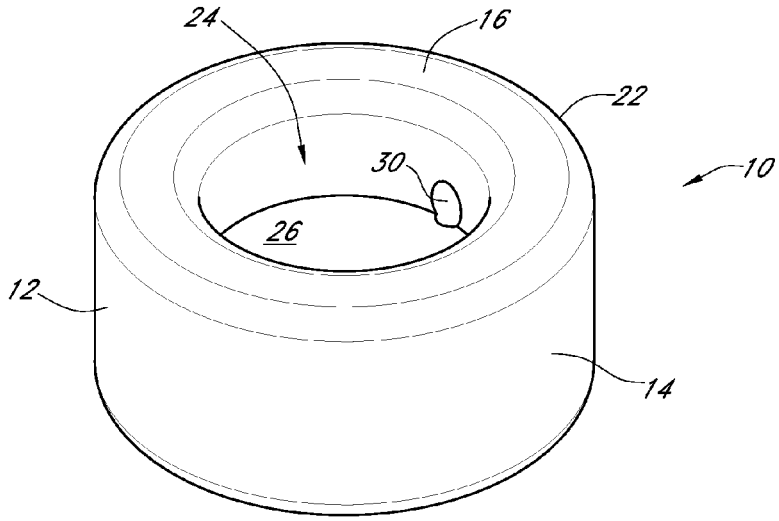
FIG. 2 is a perspective of the preferred embodiment of the invention.
Figure 3:
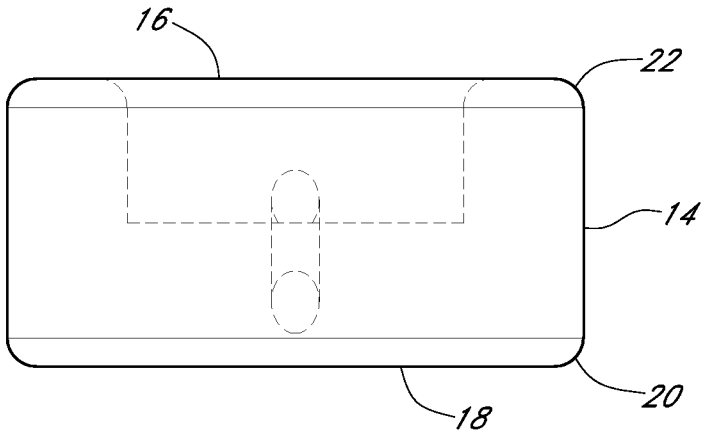
FIG. 3 is a front elevation of the embodiment of FIG. 2.
Figure 4:
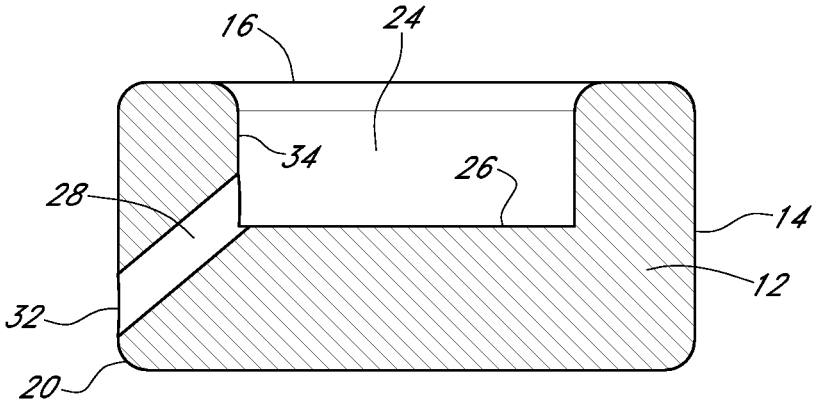
FIG. 4 is a cross section of the invention of FIG. 2.

Referring now additionally to FIGS. 2-4, the preferred embodiment of the coaster invention 10 is illustrated. Invention 10 comprises a generally cylindrical body 12 having an outer sidewall 14, a top surface 16 and a bottom surface 18. The lower edges 20 of sidewall where sidewall 14 intersects bottom surface 18 are rounded, preferably at approximately a one-quarter inch radius. The upper corner 22 where top surface 16 meets sidewall 14 is similarly rounded or alternatively may be beveled at approximately 45 degrees. Rounding of lower edge 14 is important to facilitate sliding over an uneven floor while beveling or rounding of upper corner 22 is desires to avoid retention of liquids on top of upper surface 16.

Body 12 is preferably an integral structure constructed of polyoxymethylene, commonly called polyacetal, a polymer with high durability and rigidity, excellent chemical resistance to kitchen chemicals, and a low coefficient of friction, that is, a coefficient of friction of approximately 0.25.

Body 12 is provided with a recess 24 in the upper surface 16, preferably concentric with the upper surface 16. Recess 24 includes a horizontal bottom 26 which is substantially parallel to bottom surface 18. Bottom 26 provides a support surface for the lower end of the appliance leg such as leg 7 seen in FIG. 1 or recess 24 may receive and support a caster wheel when an appliance is so equipped.

As may be best seen in FIG. 4, a bored passageway 28 is provided between recess 24 and the outer sidewall 14 of body 12. Passageway 28 provides an exit route for cleaning liquids, solvents or other liquids which may fall into recess 24 including during cleaning operations. It is seen that upper end 30 of passageway 28 communicates with recess 26 at the intersection of inner sidewall 34 and bottom 26, while lower exit end 32 opens on sidewall 14 near lower edge 20. Passageway 28 therefore provides a descending route for liquids to pass from recess 24 to the exterior of body 12.

In construction of the preferred embodiment of the invention 10, it has been determined that body may be of a height of from 1.0 to 2.0 inches, preferably approximately 1.75 inches, with a diameter of body 12 being from 2.0 to 4.0 inches, preferably 2.9 to 3.0 inches, while the diameter of recess 24 is preferably approximately 1.0 to 1.5 inches. Recess 24 is preferably cylindrical and of a depth of 0.5 to 1.0 inches. The diameter of passageway 28 is preferably about 0.25 inches. In the preferred embodiment of FIGS. 2-4, body 12 is 1.75 inches tall and recess 24 is 0.75 inches deep while the diameter of body 12 is 2.95 inches and the diameter of recess 14 is 1.5 inches.

A coaster 10 should be placed under each leg of the kitchen equipment which will need occasional or frequent relocation. If the kitchen equipment is provided with casters, a coaster 10 should be placed under each caster with the caster wheel resting within recess 24. Because of the novel structure of coaster 10, the kitchen equipment may be slid over the kitchen floor with minimum effort when cleaning is required while essentially no risk of the inadvertent escape of the leg or caster from recess 24 exists. When cleaning is complete, the kitchen equipment may be returned to its usual position.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

What is claimed is:

1. A coaster for an appliance having support members supporting a frame of the appliance above a floor surface, the coaster comprising a cylindrical body of rigid polymeric material having a low coefficient of friction, the body including a top and a bottom and a cylindrical outer sidewall interconnecting the top and the bottom, the top including a recess therein, the recess adapted to receive a lower end of one of the support members of the appliance, the recess includes an inner sidewall and a recess bottom wall, the body includes a drain hole extending between the outer sidewall and the recess, the drain hole includes an entry end and an exit end, the entry end communicative with the recess at an intersection of the inner sidewall and the recess bottom wall, the exit end terminating at the outer sidewall, the drain hole declines from its entry end to its exit end.

2. The coaster of claim 1 wherein the body is formed of polyoxymethylene.

3. The coaster of claim 1 wherein the body is rounded at an intersection of the outer sidewall and the bottom.

4. The coaster of claim 1 wherein the recess is generally cylindrical, the coefficient of friction of the polymeric material of the body is approximately 0.25.

5. The coaster of claim 1 wherein the body has a height of from one-half to two inches, the body having a diameter of approximately two to four inches, the recess having a depth of from one-quarter to one inch.

6. The coaster of claim 4 wherein the body is rounded at an intersection of the outer sidewall and the bottom, a bevel interconnects the outer sidewall and the top of the body, a bevel interconnects the inner sidewall of the recess with the top of the body.

7. The coaster of claim 1 wherein the body is formed of polyoxymethylene having a coefficient of friction of approximately 0.25, the body is rounded at an intersection of the outer sidewall and the bottom, the recess is generally cylindrical.

8. The coaster of claim 7 wherein the body has a height of from one-half to two inches, the body having a diameter of approximately two to four inches, the recess having a depth of from one-quarter to one inch.

9. The coaster of claim 7 wherein the body has a height of approximately 1.75 inches, the body having a diameter of approximately 2.9 inches, the recess having a depth of approximately 0.75 inch, the recess having a diameter of approximately 1.5 to 1.75 inches, the drain hole of a diameter of approximately 0.25 inches.

10. A support for a leg of a commercial range comprising an integral body of rigid polymeric material having a low coefficient of friction, the body having a top and a bottom and an outer sidewall interconnecting the top and the bottom, the top including a recess therein, the recess adapted to receive a lower end of the leg of the commercial range, the recess includes an inner sidewall and a recess bottom wall, the body includes a drain hole extending between the outer sidewall and the recess the drain hole includes an entry end and an exit end, the entry end communicative with the recess at an intersection of the inner sidewall and the recess bottom wall, the exit end terminating at the outer sidewall, the drain hole declines from its entry end to its exit end.

11. The support of claim 10 wherein the body is formed of polyoxymethylene.

12. The support of claim 10 wherein the rigid polymeric material has a coefficient of friction of approximately 0.25.

13. The support of claim 10 wherein the body is rounded at the intersection of the outer sidewall and the bottom.

14. The support of claim 10 wherein the body is generally cylindrical, the recess is generally cylindrical, the body is formed of polyoxymethylene.

15. The support of claim 14 wherein the body has a height of from one-half to two inches, the recess having a depth of from one-half and one inch.

16. The support of claim 14 wherein the body is rounded at the intersection of the outer sidewall and the bottom, the body includes a bevel interconnecting the outer sidewall and the top thereof, the recess including a bevel at the intersection of the inner sidewall and the top of the body.

* * * * *